US005518369A

United States Patent [19]

Modafferi

[11] Patent Number: 5,518,369

[45] Date of Patent: May 21, 1996

[54] GAS TURBINE BLADE RETENTION

[75] Inventor: Mario Modafferi, RDP Montreal, Canada

[73] Assignee: Pratt & Whitney Canada Inc., Longueuil, Canada

[21] Appl. No.: 356,094

[22] Filed: Dec. 15, 1994

[51] Int. Cl.[6] ..... F01D 5/26

[52] U.S. Cl. ..... 416/193 A; 416/221; 29/889.21

[58] Field of Search ..... 416/190, 193 A, 416/220 R, 221, 500; 29/889.2, 889.21

[56] References Cited

U.S. PATENT DOCUMENTS

| | | | |
|---|---|---|---|
| 2,847,187 | 8/1958 | Murphy | 416/221 |
| 2,942,842 | 6/1960 | Hayes | 416/220 R |
| 3,248,081 | 4/1966 | Bobo et al. | 416/193 A |
| 4,029,436 | 6/1977 | Shoup, Jr. et al. | 416/221 |
| 4,457,668 | 7/1984 | Hallinger . | |
| 4,483,661 | 11/1984 | Manharth et al. | 416/221 |
| 4,730,983 | 3/1988 | Naudet et al. | 416/221 |
| 4,872,810 | 10/1989 | Brown et al. . | |
| 5,281,097 | 1/1994 | Wilson et al. . | |

FOREIGN PATENT DOCUMENTS

| | | | |
|---|---|---|---|
| 1032753 | 6/1958 | Germany | 416/193 A |
| 671960 | 5/1952 | United Kingdom | 416/220 R |
| 925273 | 5/1963 | United Kingdom | 416/221 |

*Primary Examiner*—Edward K. Look
*Assistant Examiner*—James A. Larson
*Attorney, Agent, or Firm*—Edward I. Kochey, Jr.; Jeffrey W. Astle

[57] ABSTRACT

Gas turbine blades 14 are slid axially into disc 12 with a retention tang 22 on each abutting the disc. An axially extending space 28 between blade platforms 26 and the disc receives elongated strip 30. With prebent end 34 resiliently held against the disc the opposite end 36 is bent radially outward against the roots of adjacent blades. A bow 38 biases the blades outwardly, deterring vibration.

10 Claims, 2 Drawing Sheets

FIG. 1
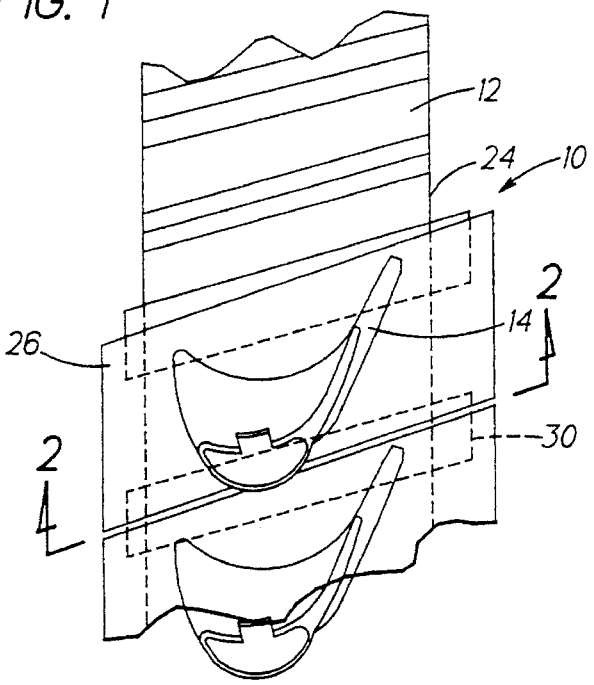
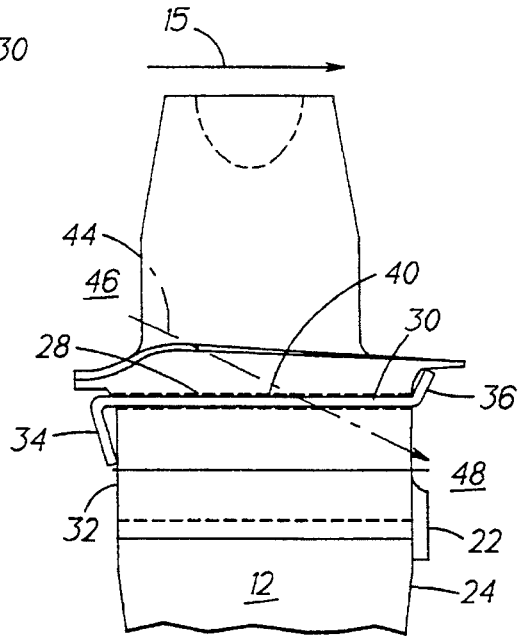
FIG. 2
FIG. 3
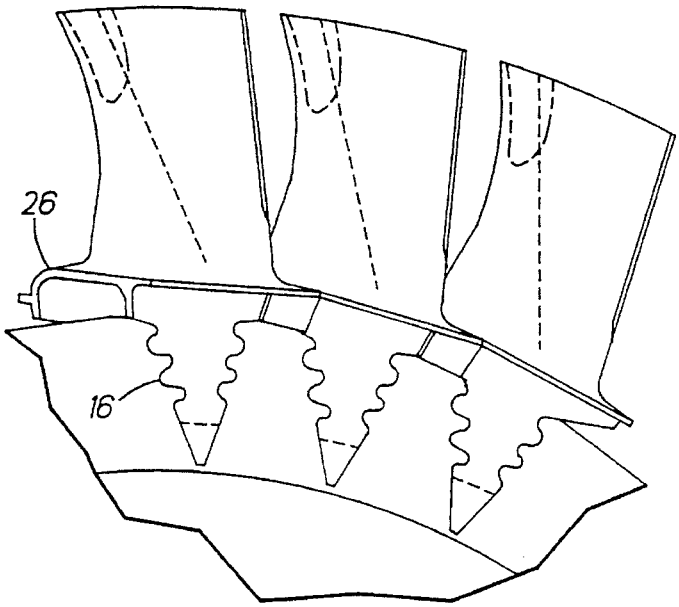

GAS TURBINE BLADE RETENTION

TECHNICAL FIELD

The invention relates to retention of gas turbine blades on a disc, and in particular to a clip which retains, dampens and seals the arrangement.

BACKGROUND OF THE INVENTION

It is conventional to secure gas turbine blades to the disc of a gas turbine with dove tail fir tree grooves in the disc. A fir tree root on the blade engages these grooves. Precise location of the blade in the radially outward direction is established by precise locations on the two fir trees. Therefore it is designed to bear against the support surface with the blade in it's radially outermost position. Inboard clearances are of course required to permit insertion of the blade.

In such an arrangement some means are required to axially retain the blade at its desired position.

At high rpm's centrifugal force will establish the blade in its outer position. However it is required that the blade have substantially the same position at balancing speed (1000 rpm) and also at tip grinding speed (100 rpm).

Sealing is required to deter gas passage from the gas path upstream of the blade, between blade platforms, to the space under the blade at the downstream side thereof.

Damping of the blades is also a benefit to reduce vibratory stresses of blades during operation.

SUMMARY OF THE INVENTION

The gas turbine blade retention arrangement comprises a gas turbine disc with dove tail recesses around the periphery of the disc, leaving dead load material between the recesses. A plurality of gas turbine blades each having a root conforming to the dove tail recesses is located in one of each of the recesses. A retention tang on one side of the blade abuts a first side of the rim.

A circumferentially extending platform is located on each of the blades. An axially extending space is located between the disc and the adjacent platforms. An elongated retention strip is located in this space with the end at the first side bent radially outward in contact with the adjacent gas turbine blades, this bending occurring after the retention strip is installed. The other end of the retention strip is bent radially inward prior to installation and remains in resilient contact with the dead load material of the disc. Accordingly the resilient end exerts a force against the disc so that the bent tab at the other end retains the gas turbine blades.

The retention strip is also bowed in the radial direction so that it is resiliently biased against the blades, continuously urging them radially outward.

BRIEF DESCRIPTION OF THE DRAWINGS

FIG. 1 is a view of the disc, the gas turbine blades and the blade platform looking radially inward from outside the gas turbine stage;

FIG. 2 is a view circumferentially taken through section 2—2 of FIG. 1;

FIG. 3 is an axial view of FIG. 2 looking upstream;

DESCRIPTION OF THE PREFERRED EMBODIMENT

Figure 4:
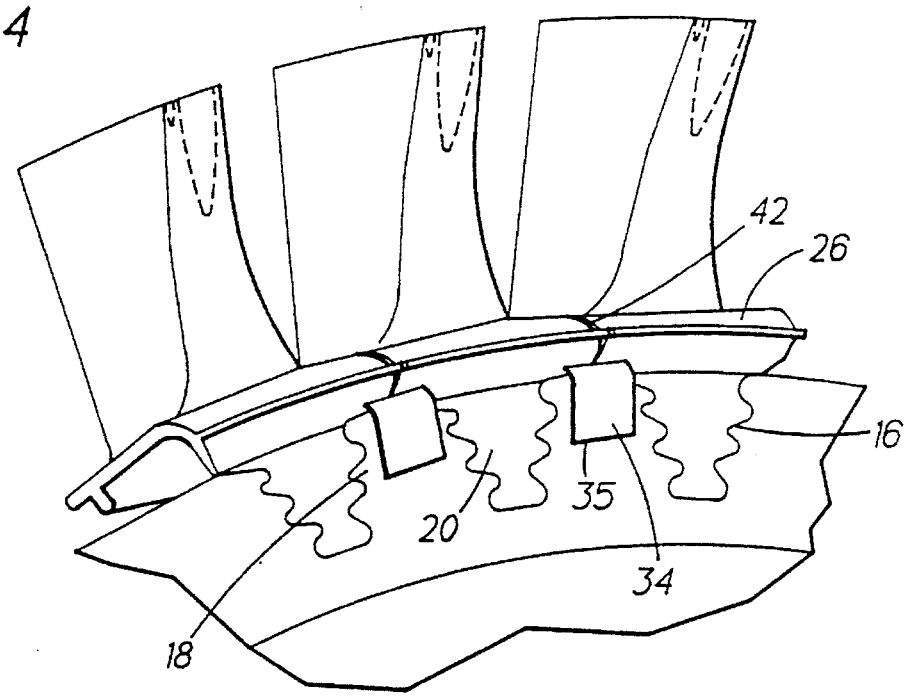
FIG. 4 is an axial view of FIG. 2 looking downstream.

Referring to FIG. 1 the gas turbine blade retention arrangement 10 includes a gas turbine disc 12 and a plurality of gas turbine blades 14 located in gas flow 15. Referring also to FIGS. 2, 3 and 4 it can be seen that there are a plurality of dove tail recesses 16 located around the periphery of the disc. These leave dead load material 18 between the recesses. Each gas turbine blade has a root 20 conforming to the dove tail recesses 16. Each root conforms to and is located in one of the recesses. A retention tang 22 is located on one side of each blade abutting the first side 24 of the disc. The blades are inserted by sliding them into the recesses from this side until tang 22 stops movement of the blade.

Circumferentially extending platforms 26 are located on each blade. Axially extending space 28 is located between the disc and adjacent blade platforms.

An elongated retention strip 30 is located in this space. It is inserted by sliding it in from the second side 32 of the rim. The resilient tab 34 is formed on the retention strip prior to installation of the strip. The strip is inserted until resilient contact is made with surface 32. Additional force is then applied to further increase resilient contact. While holding the strip in this location, tab 36 at the first end is bent upwardly or outwardly in contact with adjacent turbine blades. When the force is released resilient contact between resilient tab 34 in the face continues thereby maintaining a constant force on the gas turbine blades operating against the force applied on tab 22. Only the extreme end 35 of tab 34 is in contact with the disc.

Figure 5:
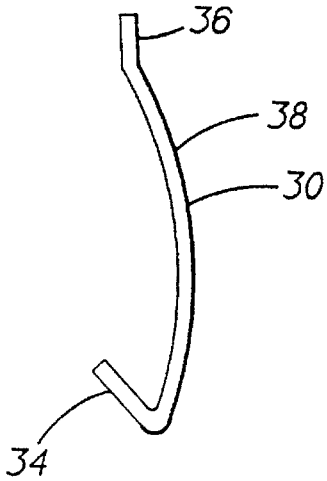
FIG. 5 is a side view of the retention strip before insertion.
Figure 6:
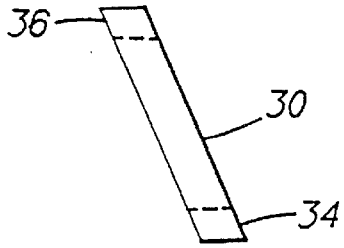
FIG. 6 is a top view of the retention strip before insertion.

FIG. 5 and 6 show the retention strip 30 in its formed condition prior to installation. End 34 which will be in resilient contact with the disc has already been bent. It is also noted that there is a bow 38 in the strip. Referring to FIG. 2 this creates a force resiliently biasing the blades radially outward at location 40. This urges the blades outwardly maintaining them in position during tip grinding of the blades at 100 rpm approximately, and during balancing of the gas turbine section at about 1000 rpm.

This force against the blades combined with the resilient retention of the strip also dampens vibration as a blade to blade damper. The retention strip also tends to restrict flow through gap 42 where flow shown by arrow 44 in FIG. 2 would otherwise pass from zone 46 in the gas passage upstream of the blade, through the gaps 42 to area 48 which is the space under the blade and downstream thereof.

FIG. 6 is a top view of the retention strip 30 also showing the tab 36 in its unbent condition.

The invention retains the turbine blades in the turbine disc and also provides a seal where the blade is secured to the disc. It acts as a blade to blade damper, and also generates a radial load to aid in balancing and tip grinding.

I claim:

1. A method of assembling a disc assembly for a gas turbine engine comprising the steps of:

sliding a first gas turbine blade axially in relation to the axis of a gas turbine disc, said disc having a first side and a second side, from said first side of said disc into engagement with said disc and against a stop;

sliding a second gas turbine blade axially in relation to the axis of said disc from said first side of said disc into engagement with said disc and against a stop, adjacent said first gas turbine blade;

inserting an elongated retention strip, said strip having a first end and a second end, axially in relation to the axis of said disc from said second side of said disc, between said disc and both said first and second blades, to bring a portion of said first end of said strip into resilient contact with said second side of said disc;

applying a force to said strip to increase the resilient contact between said portion of said first end of said strip and said second side of said disc;

bending said second end of said strip into contact with said first and second gas turbine blades on said first side of said disc while maintaining said applied force; and releasing said applied force leaving said strip in resilient contact with said disc and said blades.

2. The method as claimed in claim 1, further including the step prior to inserting said retention strip of:

introducing a bow to said retention strip for biasing said adjacent blades radially outwardly of said disc once said strip is inserted.

3. A disc assembly for a gas turbine engine comprising:

a gas turbine disc having a first side, a second side, an axis and a periphery;

axially extending dove tail recesses in the periphery of said disc with dead load material between said recesses;

a plurality of gas turbine blades, each blade having (a) a root conforming to and located within one of said recesses, (b) a retention tang on one side of said blade, said tang abutting said first side of said disc and (c) blade platforms extending circumferentially toward blade platforms of adjacent blades and terminating in closely spaced relation to said blade platforms of adjacent blades;

spaces between said disc and said blade platforms, said spaces extending axially between adjacent blade platforms; and elongated retention strips located in said spaces, each of said strips having a first end engaging adjacent blades on said one side of each of said adjacent blades, each of said retention strips having a second end resiliently engaging said dead load material on said second side of said disc to axially bias said retention tangs of said adjacent blades against said first side of said disc to axially locate said blades.

4. A disc assembly for a gas turbine engine as claimed in claim 3 wherein said second end of said step has an extreme end and wherein only said extreme end of said second end is in contact with said second side of said disc.

5. A disc assembly for a gas turbine engine as claimed in claim 3, said gas turbine engine being designed to cause a gas flow in a downstream direction toward said blades of said disc assembly, wherein said first face of said disc is downstream of said second face of said disc in said gas turbine engine.

6. A disc assembly for a gas turbine engine as claimed in claim 3 wherein said blade root has a fir tree configuration.

7. A disc assembly for a gas turbine engine comprising:

a gas turbine disc having a first side, a second side, an axis and a periphery;

axially extending dove tail recesses in the periphery of said disc with dead load material between said recesses;

a plurality of gas turbine blades, each blade having (a) a root conforming to and located within one of said recesses, (b) a retention tang on one side of said blade, said tang abutting said first side of said disc and (c) blade platforms extending circumferentially toward blade platforms of adjacent blades and terminating in closely spaced relation to said blade platforms of adjacent blades;

spaces between said disc and said blade platforms, said spaces extending axially between adjacent blade platforms; and elongated retention strips located in said spaces, each of said strips having a first end engaging adjacent blades on said one side of each of said adjacent blades, each of said retention strips having a second end resiliently engaging said dead load material on said second side of said disc to axially bias said retention tangs of said adjacent blades against said first side of said disc, each of said retention steps further resiliently biasing said adjacent blade platforms radially outwardly from said disc.

8. A disc assembly for a gas turbine engine as claimed in claim 7 wherein said second end of said step has an extreme end and wherein only said extreme end of said second end is in contact with said second side of said disc.

9. A disc assembly for a gas turbine engine as claimed in claim 7, said gas turbine engine being designed to cause a gas flow in a downstream direction toward said blades of said disc assembly, wherein said first face of said disc is downstream of said second face in said gas turbine engine.

10. A disc assembly for a gas turbine engine as claimed in claim 7 wherein said blade root has a fir tree configuration.

* * * * *

UNITED STATES PATENT AND TRADEMARK OFFICE

CERTIFICATE OF CORRECTION

PATENT NO. : 5,518,369
DATED : May 21, 1996
INVENTOR(S) : Mario Modafferi

It is certified that error appears in the above-indentified patent and that said Letters Patent is hereby corrected as shown below:

claim 4, column 3, line 45, delete "step" and insert --strip-- claim 7, column 4, line 32, delete "steps" and insert --strips-- claim 8, column 4, line 36, delete "step" and insert --strip--

Signed and Sealed this

Twenty-ninth Day of July, 1997

Bruce Lehman

*Attest:*

BRUCE LEHMAN

*Attesting Officer*

*Commissioner of Patents and Trademarks*